United States Patent [19]

Tsukada et al.

[11] Patent Number: 4,486,170

[45] Date of Patent: Dec. 4, 1984

[54] LIQUID FUEL COMBUSTION APPARATUS

[75] Inventors: Ichiro Tsukada; Yoshio Kato; Tadashi Sakai, all of Kamo, Japan

[73] Assignee: Toshiba Heating Appliances Co., Ld., Kamo, Japan

[21] Appl. No.: 494,926

[22] Filed: May 16, 1983

[51] Int. Cl.[3] ..... F23D 3/28

[52] U.S. Cl. ..... 431/315; 431/88; 431/33; 431/304

[58] Field of Search ..... 431/88, 327, 315, 308, 431/304, 306, 33, 34; 126/93, 96, 97; 74/2, 106

[56] References Cited

U.S. PATENT DOCUMENTS

| | | | |
|---|---|---|---|
| 2,800,174 | 7/1957 | Konstandt | 431/315 |

FOREIGN PATENT DOCUMENTS

| | | | |
|---|---|---|---|
| 49-9495 | 3/1974 | Japan | 431/315 |
| 50-34335 | 10/1975 | Japan | 431/315 |
| 56-10521 | 3/1981 | Japan | 431/315 |
| 56-49928 | 4/1981 | Japan | 431/315 |
| 1392773 | 4/1975 | United Kingdom | 431/315 |

*Primary Examiner*—Samuel Scott
*Assistant Examiner*—Noah Kamen
*Attorney, Agent, or Firm*—Oblon, Fisher, Spivak, McClelland & Maier

[57] ABSTRACT

In a liquid fuel combustion apparatus, the upper end of a wick is ready to be ignited when it projects upward from a pan portion, and is extinguished when it is withdrawn downward from the pan portion. The wick moves up and down as a first operating lever swings around an operating shaft. If the first operating lever is lowered, a retaining lever is raised by a bent strip. When the wick is in a position for high-temperature combustion, a retaining portion of the retaining lever engages a receiving portion of an interlocking plate. When the first operating lever is lowered, its engaging pin engages an engaging slit of an adjusting lever. If a knob of a thermal power control plate is moved up and down along a slot, the adjusting lever swings around a support pin, and the first operating lever swings slightly through the engaging pin and the engaging slit. Thus, the wick is moved up and down in a combustion region for adjustment of thermal power. If an extinction lever is operated or if a movement-sensitive pendulum is activated, the retaining portion is disengaged from the receiving portion to cause the operating shaft to rock at a stroke in an extinction direction. Thus, the wick is extinguished in an instant.

11 Claims, 12 Drawing Figures

FIG. 2
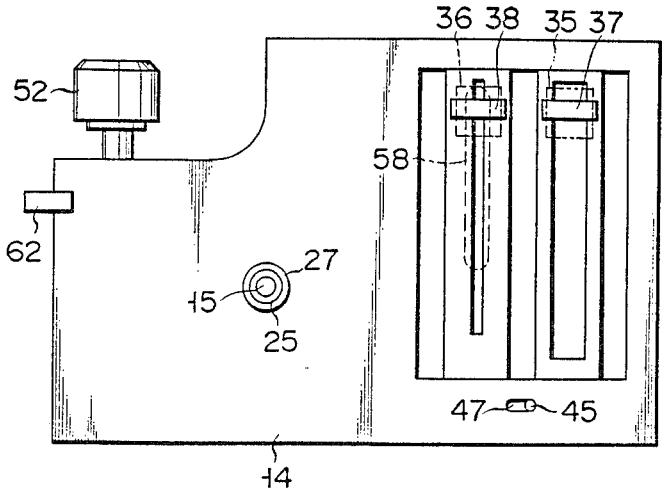
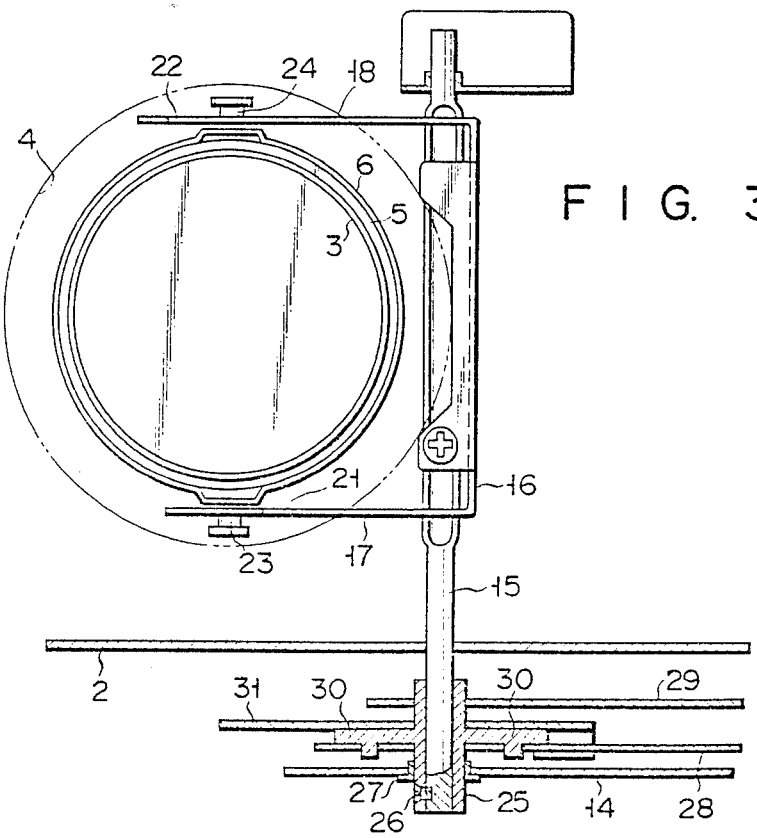
FIG. 3

LIQUID FUEL COMBUSTION APPARATUS

BACKGROUND OF THE INVENTION

This invention relates to a liquid fuel combustion apparatus, such as a portable heater, in which a wick is moved up and down for thermal power adjustment, ignition, and extinction.

In conventional combustion apparatuses of this type, combustion is sustained by the use of a wick. The wick is a cylindrical body which is formed of knitted fibers and is disposed around a wick guide cylinder for vertical movement. The lower end of the wick is normally immersed in liquid fuel. During combustion, the wick is elevated so that its upper end is located in a combustion region over a pan portion. In this position, the upper end portion of the wick is ignited for continued combustion. Thermal power is adjusted by vertically moving the wick. A satisfactory combustion condition can be obtained by moving the wick within a proper range. Normally, the proper range is as little as 5 mm or so. Therefore, it is guite possible that the wick will be excessively lowered, which will cause incomplete combustion to take place and produce an offensive smell or a great deal of carbon monoxide, or generate tar, which will stick to the wick.

A flame on the wick is extinguished by completely lowering the wick out of the combustion region. The vertical moving range of the wick for thermal power adjustment is normally about 5 mm, and the downward displacement of the wick for extinction is several times as long as vertical moving range. Conventionally, a common dial mechanism is used both for thermal power adjustment and for extinction. In completely lowering the wick for extinction, therefore, the dial must be turned a number of times, thus complicating the operation of the apparatus. Such a troublesome extinction operation sometimes induces an operator to leave the wick midway without lowering it fully to the extinction position. As a result, the fire cannot be completely extinguished, and a bad smell may be produced.

In a conventional wick elevating mechanism, a cylindrical metal wick holder surrounds the substantially whole lower half of the outer periphery of the wick. A rack is attached diagonally to the outer periphery of the wick holder, and a pinion is in mesh with the rack. Thus, the wick is moved up and down by rocking the pinion by means of an operating dial. The wick holder is coupled to the housing of the combustion apparatus by means of metal fittings or pins in order that the rack be securely in mesh with the pinion, and that the wick, as well as the wick holder, be prevented from unexpectedly slipping out of the wick guide cylinder.

Due to the use of the rack and pinion and the metal fittings or pins for coupling, however, these conventional apparatuses are complicated in construction, and require difficult assembly work. With these apparatuses, moreover, it is troublesome to remove and replace tarred wicks.

SUMMARY OF THE INVENTION

An object of this invention is to provide a liquid fuel combustion apparatus in which a wick is prevented from being excessively lowered during thermal power adjustment so as to continually maintain a satisfactory level of combustion.

Another object of the invention is to provide a liquid fuel combustion apparatus capable of complete extinction by a simple operation.

Still another object of the invention is to provide a liquid fuel combustion apparatus using a simple mechanism for elevating a wick which is also capable of easily removing and replacing the wick.

According to the invention, there is provided a liquid fuel combustion apparatus which comprises combustion means including a tank capable of storing liquid fuel, a wick one end of which is inflammable and the other end of which can be immersed in the liquid fuel in the tank, a wick holder fixedly attached to the wick, and combustion and extinction regions in which the one end of the wick can be burned and extinguished, respectively, the one end of the wick being movable along the longitudinal direction of the wick between the combustion and extinction regions, a rockable operating shaft extending substantially at right angles to the longitudinal direction of the wick, wick holder supporting means attached to the operating shaft and supporting the wick holder, the wick holder being able to move along the longitudinal direction of the wick by the rotation of the operating shaft, a first operating lever fixedly mounted on the operating shaft and swinging itself to rock the operating shaft in combustion and extinction directions, thereby moving the one end of the wick toward the combustion and extinction regions, urging means for urging, in cooperation with the first operating lever, the operating shaft to rock in the extinction direction, stop means for stopping the urging means from urging the operating shaft when the one end of the wick is in a predetermined position in the combustion region, thermal power adjusting means engaging the first operating lever when the one end of the wick is in the combustion region and moving the wick in the combustion region in cooperation with the first operating lever, and release means for releasing the operating shaft from the stopping operation of the stop means.

According to the invention, the thermal power adjusting means engages the first operating lever when the one end of the wick is in the combustion region, and moves the wick in the combustion region in cooperation with the first operating lever. Accordingly, the wick is prevented from being excessively lowered during thermal power adjustment. Thus, incomplete combustion can be reliably avoided, and a satisfactory combustion condition can be maintained at all times.

When the release means releases the operating shaft from the stopping operation of the stop means, the operating shaft is rocked in the extinction direction by the urging means. Thus, the frame can be completely extinguished in an instant by a simple operation.

BRIEF DESCRIPTION OF THE DRAWINGS

FIG. 2 is a front view showing an operation panel of the apparatus of FIG. 1;

FIG. 3 is a plan view showing a vertical transfer mechanism for a wick;

DETAILED DESCRIPTION OF THE PREFERRED EMBODIMENT

Figure 1:
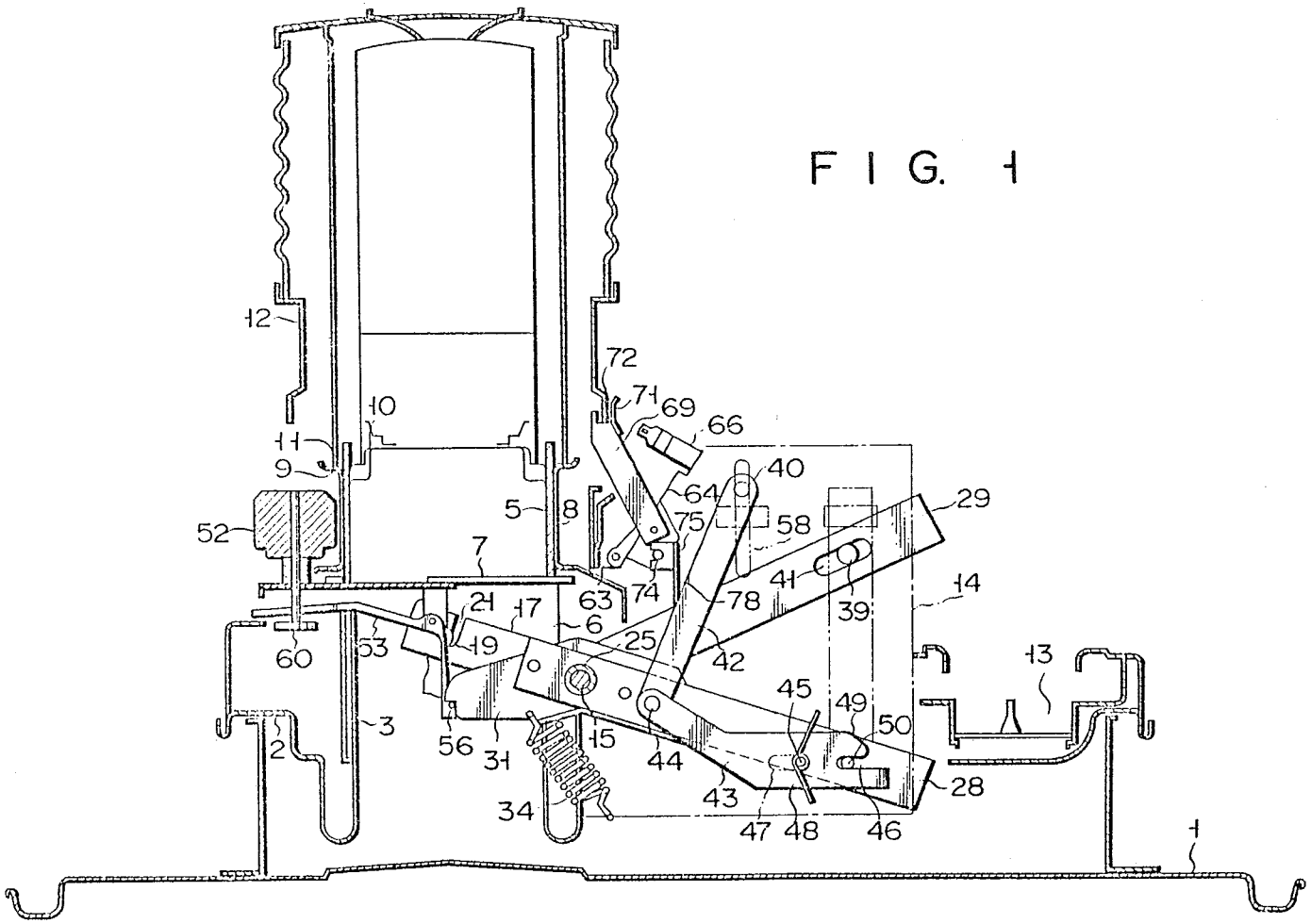
FIG. 1 is a general view of a liquid fuel combustion apparatus according to one embodiment of this invention.
Figure 10:
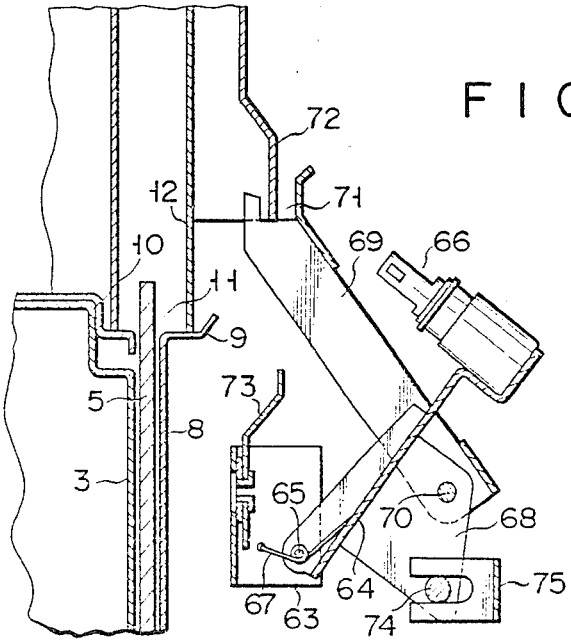
FIG. 10 is a side sectional view showing an ignition mechanism in a stand-by position.

A heater according to one embodiment of this invention will now be described with reference to the accompanying drawings. In FIG. 1, numeral 1 designates a base on which a fixed tank 2 is mounted. A wick guide cylinder 3 protrudes upwardly from one end side portion of the inner bottom surface of the fixed tank 2. The upper end portion of the wick guide cylinder 3 passes through an opening 4 in the top face of the fixed tank 2 to project upwardly therefrom. A cylindrical wick 5 formed of non-flammable fibers is fitted on the outer periphery of the wick guide cylinder 3 for vertical movement. A metal wick holder 6 with a collar 7 on its upper end edge covers substantially the whole lower half of the outer periphery of the wick 5. The wick 5 and the wick holder 6 move up and down together. A burner basket 8 is removably mounted on the top face of the fixed tank 2 so as to concentrically cover the outer periphery of the wick guide cylinder 3 which projects upwardly from the opening 4. As shown in FIG. 10, the burner basket 8 has an outwardly bent strip 9 at its upper end edge. A plate member 10 is attached to the upper end of the wick guide cylinder 3. The bent strip 9 and the plate member 10 constitute a pan portion 11. The upper end of the wick 5 is ready to be ignited when it is projected upward from the pan portion 11. The wick 5 is extinguished when its upper end is withdrawn downwardly from the pan portion 11. A combustion cylinder 12 is removably placed on the pan portion 11. An oil hole 13 is formed in the top face of the fixed tank 2 at the other end side thereof. A cartridge tank (not shown) is attached to the oil hole 13. Kerosene or other liquid fuel is fed from the cartridge tank into the fixed tank 2 so that the fuel quantity in the fixed tank 2 is normally kept at a fixed level. The lower end of the wick 5 is normally immersed in the fuel.

Figure 5:
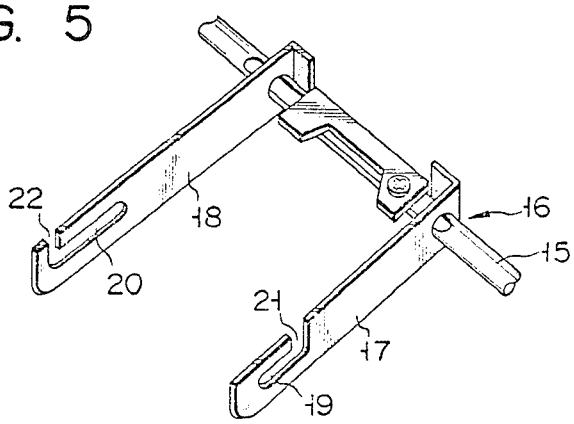
FIG. 5 is a perspective view of an interlocking member for supporting the wick.

An operation panel 14 is vertically provided inside the front panel (not shown) of the heater. The operation panel 14 is mounted on the fixed tank 2. An operating shaft 15 is rockably mounted on the panel 14 and extends horizontally from the panel 14 into the fixed tank 2. An interlocking body 16 is fixed to that portion of the operating shaft 15 which is located inside the fixed tank 2. The interlocking body 16 has a pair of arms 17 and 18 extending at right angles to the operating shaft 15 and facing each other. As shown in FIG. 3, the arms 17 and 18 extend up to two opposite portions of the peripheral surface of the wick holder 6 from the operating shaft 15. As shown in FIG. 5, fitting slits 19 and 20 are formed in the distal end portions of the arms 17 and 18, respectively, extending along the longitudinal direction thereof. The fitting slit 19 of the one arm 17 opens to the upper edge side of the arm 17 through an open passage 21 which is cut at the proximal end side of the slit 19. The fitting slit 20 of the other arm 18 opens to the upper edge side of the arm 18 through an open passage 22 which is cut at the distal end side of the slit 20. Namely, the open passages 21 and 22 are located on opposite sides. As shown in FIG. 3, shafts 23 and 24 are attached to the two opposite peripheral surface portions of the wick holder 6. The shafts 23 and 24 are loosely fitted in the fitting slits 19 and 20, respectively, so that the wick holder 6 is supported by the arms 17 and 18. A suitable means for preventing oil leakage is provided at that portion of the wall of the fixed tank 2 which is penetrated by the operating shaft 15.

A coupling cylinder 25 is fixed by means of a screw 26 to the front end of the operating shaft 15 which projects forwardly from the fixed tank 2. The coupling cylinder 25 is rockably supported on the panel 14 by means of a bearing 27. First and second operating levers 28 and 29 are disposed inside the panel 14 so that one end of each lever is coupled to the coupling cylinder 25. The first operating lever 28 is fixed to the coupling cylinder 25 by means of tongues 30 which are integrally formed on the coupling cylinder 25. The second operating lever 29 is rockably supported by the coupling cylinder 25. Between the operating levers 28 and 29, a retaining lever 31 is rockably supported by the coupling cylinder 25. The retaining lever 31 has a hooked retaining portion 32 at its end edge on one end side and a bent strip 33 fixed to the lower side edge on the other end side. The retaining lever 31 is elastically urged in the counterclockwise direction of FIG. 1 by a tension spring 34. When the retaining lever 31 rocks counterclockwise around the operating shaft 15, the bent strip 33 abuts against the lower side edge of the first operating lever 28. In this state, the first operating lever 28, along with the retaining lever 31, is elastically urged counterclockwise by the spring 34.

Figure 6:
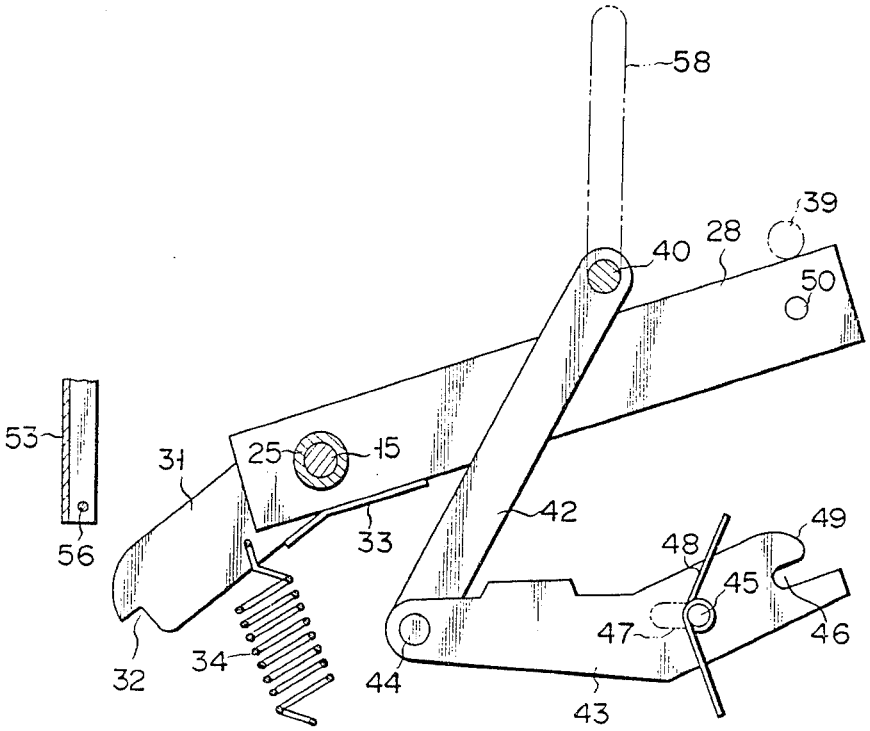
FIG. 6 is a front view showing a wick elevating mechanism in a lowered position.

As shown in FIG. 2, an ignition control plate 35 and a thermal power control plate 36 are provided to slide on the front surface of the panel 14 for vertical movement. These control plates 35 and 36 have knobs 37 and 38, respectively, on the front, and pins 39 and 40, respectively, at the back. The pin 39 of the ignition control plate 35 extends beyond the upper side portion of the first operating lever 28, and is loosely fitted in a slot 41 provided at the other end portion of the second operating lever 29. The pin 40 of the thermal power control plate 36 is passed through a vertically elongated slot 58 formed in the panel 14 so that the vertical stroke of the thermal power control plate 36 is restricted to a fixed range. As shown in FIG. 6, one end of the connecting lever 42 is rockably mounted on the extreme end of the pin 40, while one end of an adjusting lever 43 is rockably attached to the other end of the connecting lever 42 by means of a pin 44. The adjusting lever 43 has a support pin 45 protruding from substantially the middle portion thereof and an engaging slit 46 cut at the other end edge and extending along the longitudinal direction of the lever 43. The support pin 45 is loosely fitted in a horizontally elongated slot 47 formed in the panel 14, and is elastically urged toward one end side of the slot 47 by a spring 48 supported on the panel 14. An arcuate lead-in portion 49 connects the upper side edge of the engaging slit 46 and the upper side edge of the adjusting lever 43. An engaging pin 50 capable of engaging the engaging slit 46 and of being disengaged therefrom protrudes from the other end side face of the first operating lever 28.

Figure 8:
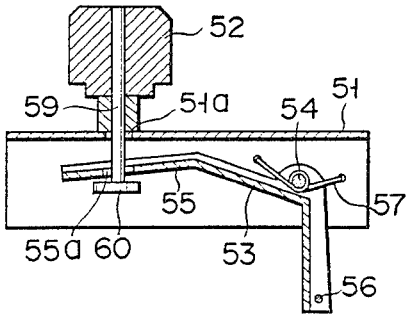
FIG. 8 is a front sectional view of an extinction mechanism.
Figure 9:
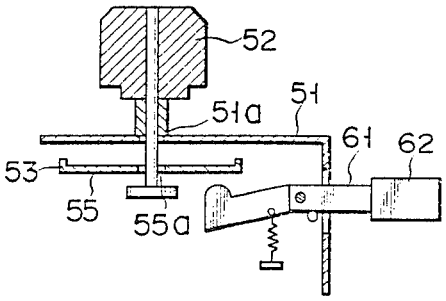
FIG. 9 is a side sectional view of the extinction mechanism.

As shown in FIGS. 8 and 9, an extinction mechanism is attached to the one end portion of the inner surface of the panel 14. The extinction mechanism comprises a frame 51 and a movement-sensitive pendulum 52 thereon. A substantially L-shaped interlocking plate 53 is disposed on the underside of the frame 51 so as to be rockable around a pin 54. The interlocking plate 53 has a sensing portion 55 on one side of the pin 54 and a receiving portion 56 on the other side capable of being engaged with and disengaged from the retaining lever 31. The interlocking plate 53 is elastically urged in the counterclockwise direction of FIG. 8 by a spring 57. Holes 51*a* and 55*a* are formed in the top face of the frame 51 and the sensing portion 55, respectively. A shaft 59 protruding from the movement-sensitive pendulum 52 is loosely passed through the holes 51*a* and 55*a*, and a disk 60 is attached to the lower end of the shaft 59. If the pendulum 52 is tilted by an earthquake or the like, the peripheral edge of the disk 60 abuts against the underside of the sensing portion 55 to rock the interlocking plate 53 against the urging force of the spring 57.

A manual extinction, or release, lever 61 is rockably attached to the frame 51, so that the interlocking plate 53 can be rocked independently of the pendulum 52 by means of the manual extinction lever 61. A knob 62 is attached to the extreme end of the manual extinction lever 61, facing the front side of the panel 14.

Figure 11:
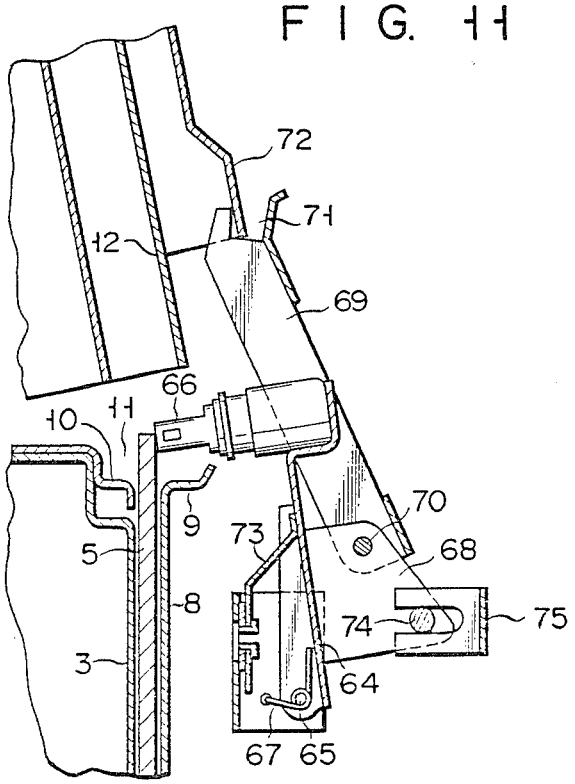
FIG. 11 is a side sectional view showing the ignition mechanism in an ignition position.
Figure 12:
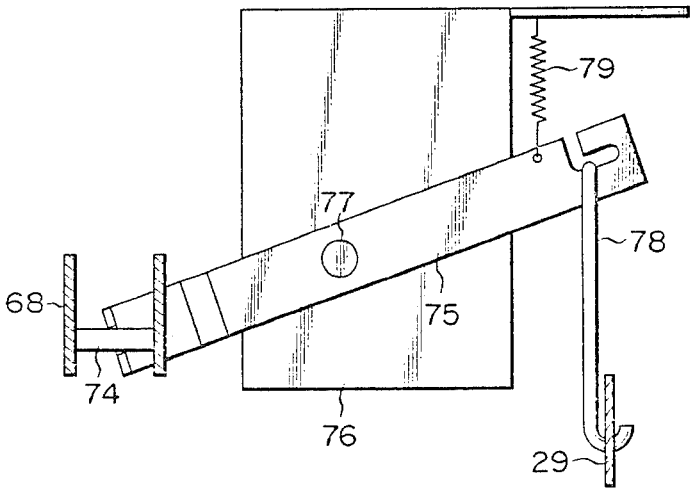
FIG. 12 is a front view of a transmission lever for coupling a second operating lever and an ignition lever.

As shown in FIGS. 10 and 11, an ignition mechanism is disposed outside the burner basket 8. An ignition lever 64 is rockably mounted on a frame 63 of the ignition mechanism by means of a shaft 65. An ignition heater 66 is attached to the free end of the ignition lever 64. The ignition lever 64 is elastically urged by a spring 67 in the direction away from the burner basket 8, i.e., in the clockwise direction of FIG. 10. A bracket 68 is attached to the middle portion of the ignition lever 64. One end of a boosting lever 69 is rockably attached to the bracket 68 by means of a shaft 70. An engaging portion 71 is formed at the other end of the boosting lever 69. The engaging portion 71 engages the lower end edge of a protective cylinder 72 which is disposed along the outermost periphery of the combustion cylinder 12. The frame 63 is provided with an electrode plate 73 connected with a battery (not shown). The electrode plate 73 faces the ignition lever 64 so that they come into contact with each other to energize the ignition heater 66 when the ignition lever 64 rocks. As shown in FIG. 12, a shaft 74 is provided at the end portion of the bracket 68, and one end of a transmission lever 75 engages the shaft 74. A support plate 76 on which the middle portion of the transmission lever 75 is rockably supported by means of a pin 77 is disposed inside the panel 14. The other end of the transmission lever 75 and the middle portion of the second operating lever 29 are coupled by a coupling rod 78. A tension spring 79 is stretched between the other end of the transmission lever 75 and the upper end of the support plate 76 so that the second operating lever 29 is urged upward or in the counterclockwise direction of FIG. 1 by the spring 79 with the aid of the coupling rod 78.

Figure 7:
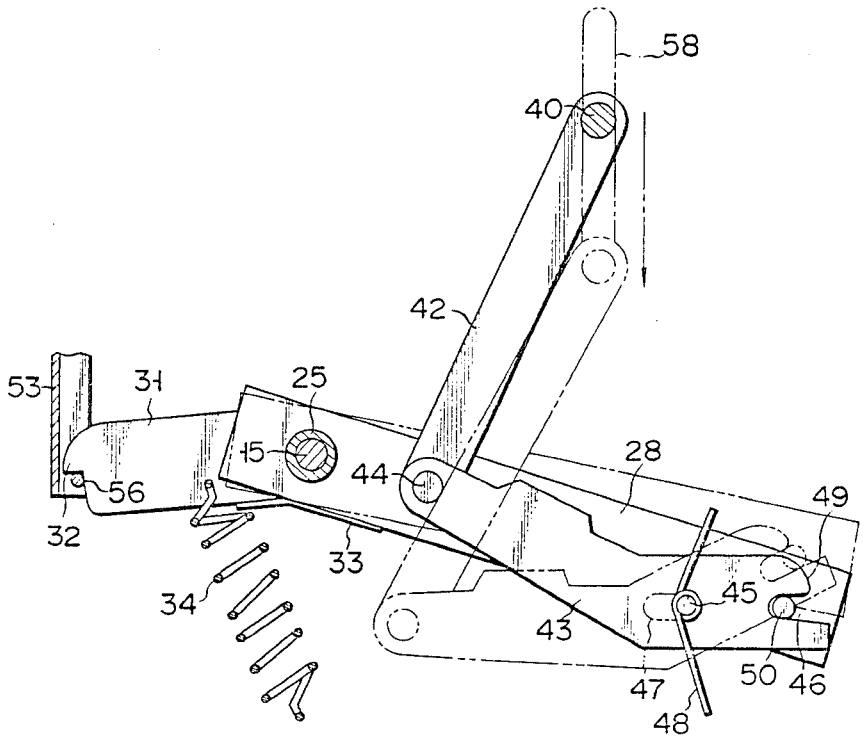
FIG. 7 is a front view showing the wick elevating mechanism in an elevated position.

The operation of the apparatus constructed in this manner will now be described. In a combustion standby mode, the first and second operating levers 28 and 29 are turned upward around the coupling cylinder 25, and the wick 5 is located at the lower end portion of the wick guide cylinder 3. Thereupon, if the knob 37 is forced down to lower the ignition control plate 35, the second operating lever 29 rocks clockwise around the coupling cylinder 25 against the urging force of the spring 79. At this time, the first operating lever 28 is forced down by the pin 39 at the back of the ignition control plate 35 (see FIGS. 6 and 7) to rock clockwise along with the second operating lever 29. As the first operating lever 28 rocks in this manner, the engaging pin 50 of the lever 28 first abuts against the lead-in portion 49 of the adjusting lever 43. As a result, the adjusting lever 43 is moved to the left of FIGS. 6 and 7 against the urging force of the spring 48. When the engaging pin 50 passes the lead-in portion 49, the adjusting lever 43 is returned to the right by the urging force of the spring 48, and the urging pin 50 engages the engaging slit 46. As the engaging pin 50 is further lowered, the adjusting lever 43 rocks clockwise around the support pin 45. As the adjusting lever 43 rocks in this manner, the thermal power control plate 36 is forced up by the connecting lever 42, as shown in FIG. 7. As the first operating lever 28 rocks, the operating shaft 15 rocks together, so that the wick 5 is pulled up together with the wick holder 6 by the interlocking body 16. Thus, the wick 5 projects into the pan portion 11 or the region for combustion. When the first operating lever 28 is pushed down to its lowermost position, the wick 5 is held in the highest ignition position. As the second operating lever 29 rocks as shown in FIG. 12, the operating lever 29 side of the transmission lever 75 is forced down by means of the coupling rod 78, while the bracket 68 side is elevated. Consequently, the ignition lever 64 rocks around the shaft 65 against the urging force of the spring 67, as shown in FIG. 11. As the ignition lever 64 rocks in this manner, the boosting lever 69 rises to force up one lateral face side of the combustion cylinder 12. Thus, the combustion cylinder 12 is tilted, and that part of the pan portion 11 which faces the ignition heater 66 is opened. As the ignition lever 64 rocks in the aforesaid manner, it comes into contact with the electrode plate 73 to energize the ignition heater 66. Thus heated, the ignition heater 66 penetrates into the region over the pan portion 11 and touches the upper end of the wick 5 to ignite it. The first operating lever 28 rocks together with the retaining lever 31, as shown in FIG. 7. After the hooked retaining portion 32 at the one end of the retaining lever 31 touches and pushes aside the receiving portion 56 of the interlocking plate 53 of the extinction mechanism, the retaining lever 31 rocks further.

After the wick 5 is ignited, the ignition control plate 35 is released. As a result, the second operating lever 29 is rocked in the counterclockwise direction of FIG. 1 by the urging force of the spring 79 to return to its initial position. In response to this, the ignition lever 64 and the boosting lever 69 are returned to their initial positions by the urging force of the spring 67, and the combustion cylinder 12 is set upright on the pan portion 11. As the second operating lever 29 rocks and returns to its initial position, the first operating lever 28 and the retaining lever 31 is also rocked in the counterclockwise direction of FIG. 7 by the urging force of the spring 34. After the retaining lever 31 is rocked slightly, the retaining portion 32 of the retaining lever 31 is caught by the receiving portion 56 of the extinction mechanism, which acts as a stop means for limiting the extent to which the spring 34 can rock the first operating lever 28 in the counterclockwise direction. Thus, the range of counterclockwise rocking of both the first operating lever 28 and the retaining lever 31 may be minimized.

As the first operating lever 28 rocks in the aforesaid manner, the wick 5 is brought down a short distance from the ignition position, and is settled in a position for high-temperature combustion. If this position is maintained, therefore, high-temperature combustion will continue.

For medium- or low-temperature combustion, on the other hand, the thermal power control plate 36 is forced down. If the knob 38 is pushed down to lower the thermal power control plate 36, this action is transmitted to the adjusting lever 43 through the connecting lever 42, as shown in FIG. 7. Thereupon, the adjusting lever 43 rocks counterclockwise around the support pin 45. As the engaging slit 46 is engaged with the engaging pin 50, the adjusting lever 43 is coupled to the first operating lever 28. As the adjusting lever 43 rocks in the counterclockwise direction, therefore, the first operating lever 28 rocks counterclockwise around the operating shaft 15. Although the first operating lever 28 is restricted in its clockwise motion by the bent strip 33 of the retaining lever 31, it is not restricted in counterclockwise motion. Accordingly, the first operating lever 28 rocks freely, accompanying the adjusting lever 43. As the first operating lever 28 rocks in this manner, the wick 5 is pulled down from the position for high-temperature combustion to a position for medium- or low-temperature combustion, depending on the extent of depression of the thermal power control plate 36. Thereafter, combustion for the set thermal power is continued. The condition of high-temperature combustion can be restored by raising the thermal power control plate 36.

The thermal power control plate 36 is restricted in its moving range by the slot 58. Therefore, the lowermost position of the wick 5 for combustion is settled in a proper fixed position which depends on the location of the lower end of the slot 58. Thus, the wick 5 is prevented from being excessively lowered, so that incomplete combustion is avoided, and a proper combustion condition can be ensured at all times. A high flame is obtained if the height of the projection of the wick 5 in the pan portion 11 is e.g., 8 mm, while a low flame is obtained if the height of the projection is e.g., 3 mm. That is, the flame or thermal power is adjusted by vertically moving the wick 5 within a narrow range of approximately 5 mm. The wick 5 and the thermal power control plate 36 moving therewith are connected by means of the operating lever 28, the adjusting lever 43, and the connecting lever 42. Accordingly, the displacement of the thermal power control plate 36 increases as that of the wick 5 increases. Thus, the vertical position of the wick 5 can be finely adjusted by moving the thermal power control plate 36. In this embodiment, the moving range of the thermal power control plate 36 is extended six times, i.e., 30 mm.

In the conventional combustion apparatus, the wick is vertically moved by turning a dial. To extensively move the wick in these dial-type apparatuses, however, the operator must turn the dial several times. This operation is troublesome. According to the present embodiment, the wick 5 is moved up and down by vertically moving the thermal power control plate 36, so that the operation can be easily performed with a single stroke for high efficiency.

In ignition, the wick 5 is raised above the position for high-temperature combustion. By doing this, the retaining portion 32 is carried beyond the location of the receiving portion 56. Then, the wick 5 is lowered from the ignition position to the high-temperature combustion position so that the retaining portion 32 is caught by the receiving portion 56. Thus, the engagement between the retaining portion 32 and the receiving portion 56 is ensured. If both ignition and the engagement between the retaining portion 32 and the receiving portion 56 are simultaneously attempted, the engagement will fail due to variations on assembly work and the like, although ignition will be achieved. Thereupon, if the ignition control plate 35 is released from depression, the wick 5 may escape from the combustion region and return to the initial extinction position thereunder. To avoid this, a time lag is provided between the ignition and the engagement.

The flame on the wick 5 is extinguished by depressing the knob 62 of the manual extinction lever 61, the knob 62 acting as a release means for releasing the operating shaft 15 from the stopping operation effected by the engagement of the retaining portion 32 of the retaining lever 31 with the receiving portion 56 of the extinction mechanism. If the knob 62 is pushed down, the manual extinction lever 61 is turned to rock the interlocking plate 53 clockwise around the pin 54 against the urging force of the spring 57. As the interlocking plate 53 rocks in this manner, the receiving portion 56 is disengaged from the retaining portion 32 of the retaining lever 31. As a result, the retaining lever 31 is rocked counterclockwise by the elastic force of the spring 34. At this time, the bent strip 33 of the retaining lever 31 abuts against the lower side edge of the first operating lever 28, so that the first operating lever 28 rocks together with the retaining lever 31 in the counterclockwise direction of FIG. 6. As the first operating lever 28 rocks counterclockwise, the engaging pin 50 of the operating lever 28 is disengaged from the engaging slit 46 of the adjusting lever 43. At the same time, the operating shaft 15 also rocks counterclockwise to rapidly lower the wick 5 at a single stroke through the interlocking body 16. Thus, instantaneous extinction is achieved.

If an earthquake occurs during combustion, or if the heater is accidentally tipped over, the pendulum 52 is tilted, and the disk 60 of the pendulum 52, like the manual extinction lever 61, rocks the interlocking plate 53 to provide instantaneous extinction, thus maintaining the safety of the apparatus.

Figure 4:
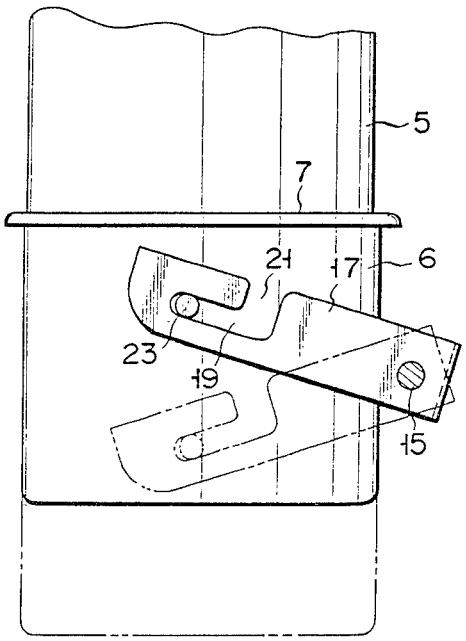
FIG. 4 is a side view of wick supporting means.

Referring now to FIGS. 3 to 5, the process of mounting the wick holder 6 on the interlocking body 16 will be described. First, the wick holder 6, along with the wick 5, is fitted on the outer periphery of the wick guide cylinder 3. In this case, the wick holder 6 is not accompanied with the burner basket 8. Then, the arms 17 and 18 of the interlocking body 16 are kept horizontal by fingers, and the shafts 23 and 24 of the wick holder 6 are fitted in the open passages 21 and 22, respectively. Thereafter, the wick holder 6 is rocked about its axis to shift the shafts 23 and 24 to those closed ends of the fitting slits 19 and 20 which are on the sides opposite the open passages 21 and 22, respectively. Thus, the mounting of the wick holder 6 on the interlocking body 16 is completed. The distal end portions of the arms 17 and 18 of the interlocking body 16 are inclined diagonally upward and downward during combustion and extinction, respectively. Since the arms 17 and 18 are thus tilted, the wick holder 6 will be restrained from rocking by the fitting slits 19 and 20 even if it is subjected to a rotatory force. That is, if the wick holder 6 is urged to rock counterclockwise about its axis from the position indicated by a full line in FIG. 4, the shaft 23 is urged to move downward along the fitting slit 19. The other shaft 24, on the other hand, is urged to rise along the fitting slit 20, so that the wick holder 6 can neither ascend nor descend. Thus prevented from rocking, the wick holder 6 will never be disengaged from the arms 17 and 18. The wick holder 6 is allowed to rock only when the arms 17 and 18 are horizontal. However, the arms 17 and 18 are kept horizontal only for a brief interval when the apparatus is switched from combustion to extinction.

If the wick 5 is soiled with tar or the like and needs to be removed from the interlocking body 16 for replacement, then the operator simply follows the aforesaid mounting process in reverse while keeping the arms 17 and 18 horizontal with his fingers. Thus, the wick holder 16 can be readily attached to and detached from the interlocking body 16.

What is claimed is:

1. A liquid fuel combustion apparatus comprising:

combustion means including a tank capable of storing liquid fuel, a wick one end of which is inflammable and the other end of which can be immersed in the liquid fuel in the tank, a wick holder fixedly attached to the wick, and combustion and extinguish regions in which the one end of the wick can be burned and extinguished, the one end of the wick being movable along the longitudinal direction of the wick between the combusion and extinguish regions;

a rockable operating shaft extending substantially at right angles to the longitudinal direction of the wick;

wick holder supporting means attached to the operating shaft and supporting the wick holder, the wick holder being able to move along the longitudinal direction of the wick by the rotation of the operating shaft;

a first operating lever fixedly mounted on the operating shaft and swinging itself to rock the operating shaft in combustion and extinguish directions, thereby moving the one end of the wick toward the combustion and extinguish regions, respectively;

urging means for urging, in cooperation with the first operating lever, the operating shaft to rock in the extinguish direction, said urging means including a retaining lever rockably mounted on the operating shaft, an elastic member for urging the retaining lever to rock in the same direction as the extinguish direction of the operating shaft, and an engaging member for engaging the retaining lever and the first operating lever to rock the two levers in the same direction when the retaining lever rocks in the extinguish direction or when the first operating lever rocks in the combustion direction;

stop means for stopping the urging means from urging the operating shaft toward the extinguish region when the one end of the wick is in a predetermined position in the combustion region;

wick position adjusting means engaging the first operating lever when the one end of the wick is in the combustion region and moving the wick in the combustion region in cooperation with the first operating lever; and release means for disengaging the stop means so that the urging means can return the wick to the extinguish region.

2. The liquid fuel combustion apparatus according to claim 1, wherein said retaining lever has a notch-shaped retaining portion, and said stop means includes an interlocking member having a sensing portion and a receiving portion, the receiving portion being capable of engaging the retaining portion on said retaining lever, a pin rockably supporting the interlocking member, and a spring for urging the interlocking member in such a direction that the receiving portion engages the retaining portion, so that said retaining lever is not prevented from rocking in the combusion direction by the stop means, but is stopped from rocking in the extinguish direction when the retaining portion and the receiving portion engage.

3. The liquid fuel combustion apparatus according to claim 2, wherein said release means includes a release lever for rocking the interlocking member in such a direction that the retaining portion is disengaged from the receiving portion.

4. The liquid fuel combustion apparatus according to claim 3, wherein said release means includes a movement-sensitive pendulum sensing vibration and rocking the interlocking member in such a direction that the retaining portion is disengaged from the receiving portion.

5. The liquid fuel combustion apparatus according to claim 1, wherein said thermal power adjusting means includes an adjusting knob, restricting means for restricting the range of movement of the adjusting knob, an adjusting lever capable of engaging the first operating lever, and a connecting lever for coupling the adjusting knob and the adjusting lever, said first operating lever engaging the adjusting lever when the one end of the wick is in the combustion region, so that the wick is moved in the combustion region by the first operating lever as the adjusting knob moves within the range of movement thereof with the first operating lever and the adjusting lever in engagement.

6. The liquid fuel combustion apparatus according to claim 1, further comprising a second operating lever rockably mounted on the operating shaft, and ignition means for igniting the one end of the wick, said ignition means including a rockable ignition lever, an ignition heater attached to the ignition lever, the ignition heater touching the one end of the wick to ignite the same as the ignition lever rocks, transmission means transmitting the action of the second operating lever to the ignition lever to rock the same, and means for supplying electric power to the ignition heater when the ignition heater comes into contact with the one end of the wick.

7. The liquid fuel combustion apparatus according to claim 6, wherein said combustion means includes a combustion cylinder surrounding the wick, and said ignition means includes a boosting lever for lifting the combustion cylinder to allow the ignition heater to touch the wick when the ignition lever, in conjunction with the transmission means, rocks in such a direction that the ignition heater is brought into contact with the wick.

8. The liquid fuel combustion apparatus according to claim 7, wherein said transmission means includes a transmission lever swingably mounted on a shaft, a coupling member coupling one end of the transmission lever and the second operating lever, and a bracket fixed to the ignition lever and coupled with the other end of the transmission lever, the other end of the transmission lever being connected to the bracket so that the ignition lever rocks as the transmission lever swings, and said boosting lever being attached to the bracket so as to be rotatable relative thereto.

9. The liquid fuel combustion apparatus according to claim 1, wherein said wick holder supporting means includes an interlocking body attached to the operating shaft, the interlocking body having a pair of arms which extend from the operating shaft toward the side portions of the wick holder so that the arms rockably support the wick holder.

10. The liquid fuel combustion apparatus according to claim 9, wherein said wick holder has a pair of mounting shafts in positions where the wick holder is supported by the arms, said arms having their respective fitting slits extending along the longitudinal direction of the arms in positions in alignment with their corresponding mounting shafts, a first open passage formed at the arm's proximal end side of one fitting slit and extending upward therefrom, and a second open passage formed at the arm's distal end side of the other fitting slit and extending upward therefrom, and said wick holder is attached to the interlocking body by inserting the mounting shafts into the fitting slits through the first and second open passages and rotating the wick holder on its axis to locate the mounting shafts on the closed end side of each corresponding fitting slit.

11. The liquid fuel combustion apparatus according to claim 8, wherein said first operating lever rocks in such a direction that the operating shaft is rocked in the combustion direction, in conjunction with the second operating lever, when the second operating lever rocks the ignition lever in such a direction that the ignition heater comes into contact with the wick.

* * * * *